US008217845B2

(12) United States Patent
Kubota et al.

(10) Patent No.: US 8,217,845 B2
(45) Date of Patent: Jul. 10, 2012

(54) HIGH FREQUENCY GLASS ANTENNA FOR AUTOMOBILES

(75) Inventors: Masato Kubota, Tokyo (JP); Kenichi Ishii, Tokyo (JP); Yasuhito Horie, Tokyo (JP); Kenichiro Shimo, Tokyo (JP); Mitsuro Watanabe, Tokyo (JP); Kazuyoshi Noda, Tokyo (JP)

(73) Assignee: Asahi Glass Company, Limited, Tokyo (JP)

( * ) Notice: Subject to any disclaimer, the term of this patent is extended or adjusted under 35 U.S.C. 154(b) by 260 days.

(21) Appl. No.: 12/643,334

(22) Filed: Dec. 21, 2009

(65) Prior Publication Data

US 2010/0097278 A1 Apr. 22, 2010

Related U.S. Application Data

(63) Continuation of application No. PCT/JP2008/061420, filed on Jun. 23, 2008.

(30) Foreign Application Priority Data

Jun. 22, 2007 (JP) ..... 2007-165077

(51) Int. Cl.
*H01Q 1/32* (2006.01)

(52) U.S. Cl. ..... 343/713; 343/704

(58) Field of Classification Search ..... 343/713, 343/704

See application file for complete search history.

(56) References Cited

U.S. PATENT DOCUMENTS

| | | | | |
|---|---|---|---|---|
| 6,201,505 | B1 * | 3/2001 | Terashima et al. | 343/713 |
| 6,208,303 | B1 * | 3/2001 | Tachihara et al. | 343/704 |
| 6,307,516 | B1 * | 10/2001 | Zafar et al. | 343/713 |
| 2007/0247379 | A1 | 10/2007 | Oshima et al. | |

FOREIGN PATENT DOCUMENTS

| | | |
|---|---|---|
| JP | 7-245516 | 9/1995 |
| JP | 9-289412 | 11/1997 |
| JP | 10-209731 | 8/1998 |
| JP | 11-112220 | 4/1999 |
| JP | 2001-326515 | 11/2001 |
| JP | 2002-185230 | 6/2002 |
| JP | 2003-142914 | 5/2003 |
| JP | 2007-295536 | 11/2007 |
| WO | WO 2006/001486 A1 | 1/2006 |

* cited by examiner

*Primary Examiner* — Hoanganh Le
(74) *Attorney, Agent, or Firm* — Foley & Lardner LLP

(57) ABSTRACT

There is provided a high frequency glass antenna for automobiles which is capable of having an improved antenna gain without changing the shape of a defogger.

A defogger, an antenna conductor, a feeding portion for the antenna conductor, a grounding conductor, and a grounding-side feeding portion for the grounding conductor are disposed in or on a rear window glass sheet for automobiles, the defogger forms at least one portion of the grounding conductor; and the grounding-side feeding portion is electrically connected to the defogger.

20 Claims, 12 Drawing Sheets

HIGH FREQUENCY GLASS ANTENNA FOR AUTOMOBILES

TECHNICAL FIELD

The present invention relates to a high frequency glass antenna for automobiles and a rear window glass sheet thereof, which are appropriate to receive a signal in a frequency band from 300 MHz to 2 GHz, a digital terrestrial television broadcast in Japan (470 to 770 MHz), a UHF band analog television broadcast (473 to 767 MHz), or a US digital television broadcast (698 to 806 MHz).

BACKGROUND ART

Heretofore, a high frequency glass antenna for automobiles having the purpose of receiving a signal in a digital terrestrial television broadcast, which is shown in FIG. 21, has been reported in International Publication No. WO2006/001486. In this prior art, a rear window glass sheet 14 has a defogger, an antenna conductor 31 and a feeding point 32 disposed thereon, the defogger being formed of a plurality of heating wires 33 and bus bars 35. The highest heating wire 34 that is located just under the antenna conductor 31 has a meander shape. This arrangement alleviates the influence of the heating wires 33 and 34 on the antenna conductor 31 to obtain an improved antenna gain.

However, this prior art has a problem in that the glass antenna has poor appearance and hinders a sight since the heating wire 34 has such a meander shape.

DISCLOSURE OF THE INVENTION

Problems that the Invention is to Solve

It is an object of the present invention to provide a high frequency glass antenna for automobiles, which solves the above-mentioned problem of the prior art.

Means of Solving the Problems

The present invention provides:

1) A high frequency glass antenna for automobiles, wherein an electric heating defogger having a plurality of heating wires and a plurality of bus bars for feeding the heating wires, an antenna conductor, a feeding portion for the antenna conductor, a grounding conductor, and a ground-side feeding portion for the grounding conductor are adapted to be disposed in or on a rear window glass sheet for automobiles in such a way that a signal received by the antenna conductor is taken out from the feeding portion for the antenna conductor, utilizing the ground-side feeding portion as a ground reference, being characterized in that;

the defogger forming at least one portion of the grounding conductor; and the ground-side feeding portion being electrically connected to the defogger.

2) The high frequency glass antenna recited in the above-mentioned item 1), wherein the ground-side feeding portion is disposed at a bus bar closest to the feeding portion in the plurality of bus bars.

3) The high frequency glass antenna recited in the above-mentioned item 1), wherein the ground-side feeding portion is connected to the defogger through a connection conductor for the defogger in terms of direct-current.

4) The high frequency glass antenna recited in the above-mentioned item 1), wherein the ground-side feeding portion is electrically connected to the defogger through capacitive coupling.

5) The high frequency glass antenna recited in any one of the above-mentioned items 1) to 4), wherein the grounding conductor includes an adjusting element connected to at least one of the defogger and the ground-side feeding portion.

6) The high frequency glass antenna recited in the above-mentioned item 5), wherein the adjusting element includes a capacitively-coupling conductor, the capacitively-coupling conductor being disposed to be close and capacitively coupled to the antenna conductor, starting at least one of the defogger and the ground-side feeding portion.

7) The high frequency glass antenna recited in the above-mentioned item 6), wherein the grounding conductor includes a short-circuit line, and the capacitively-coupling conductor being disposed, starting at a heating wire, the short circuit line being disposed to extend so as to traverse at least two of the plurality of heating wires, starting at a joint between the capacitively-coupling conductor and the heating wire or at a location close to the joint.

8) The high frequency glass antenna recited in the above-mentioned item 6) or 7), wherein the antenna conductor and the capacitively-coupling conductor have an average distance of 0.1 to 35 mm between capacitively-coupling portions thereof.

9) The high frequency glass antenna recited in any one of the above-mentioned items 6) to 8), wherein when a desired frequency band has a center frequency having a wavelength of $\lambda_0$ in the air, glass has a shortening coefficient of wavelength of k, the formula of k=0.64 is established, and the formula of $\lambda_g=\lambda_0 \cdot k$ is established, the heating wire has a conductor length extending from a joint between the capacitively-coupling conductor and the heating wire to a bus bar closest to the joint, the conductor length being set at $(1/8)\cdot(\lambda_g/4)$ to $(5/4)\cdot(\lambda_g/4)$.

10) The high frequency glass antenna recited in any one of the above-mentioned items 6) to 9), wherein the heating wire has a conductor length extending from a joint between the capacitively-coupling conductor and the heating wire to a bus bar closest to the joint, the conductor length being 10 to 100 mm.

11) The high frequency glass antenna recited in the above-mentioned item 5), wherein the adjusting element is attached to a bus bar closest to the ground-side feeding portion and has an upwardly extending element extending upwardly along an outline of the rear window glass sheet.

12) The high frequency glass antenna recited in the above-mentioned item 11), wherein when a desired frequency band has a center frequency having a wavelength of $\lambda_0$ in the air, glass has a shortening coefficient of wavelength of k, the formula of k=0.64 is established, and the formula of $\lambda_g=\lambda_0 \cdot k$ is established, the upwardly extending element has a conductor length set at $(7/8)\cdot(\lambda_g/4)$ to $(15/8)\cdot(\lambda_g/4)$.

13) The high frequency glass antenna recited in the above-mentioned item 11) or 12), wherein the upwardly extending element has a conductor length set at 70 mm to 150 mm.

14) The high frequency glass antenna recited in the above-mentioned item 5), wherein the adjusting element is attached to a bus bar closest to the ground-side feeding portion and has a downward capacitively-coupling element extending downwardly along the bus bar and capacitively coupled to the bus bar.

15) The high frequency glass antenna recited in the above-mentioned item 14), wherein when a desired frequency band has a center frequency having a wavelength of $\lambda_0$ in the air, glass has a shortening coefficient of wavelength of k, the formula of k=0.64 is established, and the formula of $\lambda_g=\lambda_0 \cdot k$ is established, the downward extending element has a conductor length set at $(7/8)\cdot(\lambda_g/4)$ to $(15/8)\cdot(\lambda_g/4)$.

16) The high frequency glass antenna recited in the above-mentioned item 14) or 15), wherein the downward capacitively-coupling element has a conductor length set at 70 mm to 150 mm.

17) The high frequency glass antenna recited in the above-mentioned item 5), wherein the adjusting element is attached to a bus bar closest to the ground-side feeding portion, the bus bar extends upwardly beyond a joint with a highest heating wire connected thereto and has a laterally extending element extending from an upper end of the bus bar or a portion thereof close to the upper end so as to be parallel to the heating wire.

18) The high frequency glass antenna recited in any one of the above-mentioned item 17), wherein when a desired frequency band has a center frequency having a wavelength of $\lambda_0$ in the air, glass has a shortening coefficient of wavelength of k, the formula of k=0.64 is established, and the formula of $\lambda_g=\lambda_0 \cdot k$ is established, the laterally extending element has a conductor length set at $(5/8)\cdot(\lambda_g/4)$ to $(19/16)\cdot(\lambda_g/4)$.

19) The high frequency glass antenna recited in the above-mentioned item 18), wherein the laterally extending element has a conductor length set at 50 mm to 95 mm.

20) A rear window glass sheet having a high frequency glass antenna for automobiles recited in any one of the above-mentioned items 1) to 19).

Effects of the Invention

In accordance with the present invention, it is possible to alleviate the influence of a heating wire on the antenna conductor so as to obtain an improved antenna gain in a frequency band of 300 MHz to 2 GHz, in particular in a digital television broadcast band, by adopting such arrangement. It is also possible to prevent the appearance from being degrading and to secure a sight in a good state since it is possible to obtain an improved antenna gain without a change in the shape of a heating wire.

EXPLANATION OF REFERENCES

Figure 1:
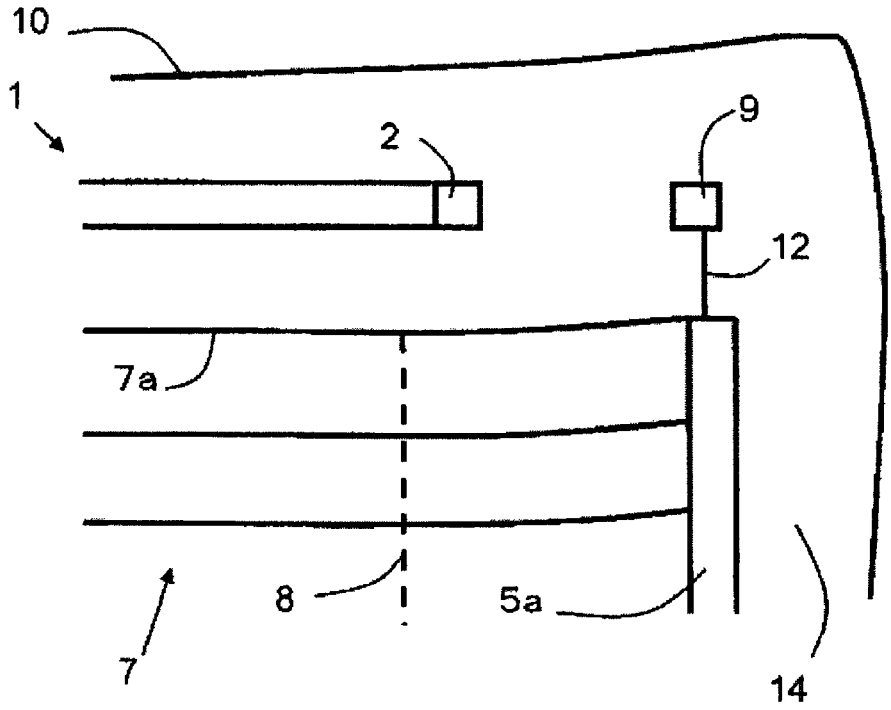
FIG. 1 is a plan view showing the high frequency glass antenna for automobiles according to a first embodiment of the present invention.

1: Antenna conductor
1*a*: Capacitively-coupling portion of antenna conductor
2: Feeding portion for antenna conductor
3: Capacitively-coupling conductor
3*a*: Capacitively-coupling portion of capacitively-coupling conductor
3*b*: Attaching portion of capacitively-coupling conductor
4: Capacitively-coupling area
5*a*: Right bus bar
7: Heating wires
7*a*: Highest position of heating wire
8: Short-circuit line disposed as needed
9: Ground-side feeding portion
10: Vehicle opening edge
12: Connection conductor for defogger
13: Upwardly extending element
14: Rear window glass sheet
22: Capacitively-coupling conductor for defogger
23: Downward capacitively-coupling element
33: Laterally capacitively-coupling element

BEST MODE FOR CARRYING OUT THE INVENTION

In the present invention, an electric heating defogger, which includes a plurality of heating wires and a plurality of bus bars for feeding the heating wires, is disposed on or in the rear window glass sheet of an automobile. The rear window glass sheet has an antenna conductor disposed on or in an upper blank space thereof except for an area where the defogger is disposed.

In the present invention, the defogger is formed as at least a part of a grounding conductor, the defogger is electrically connected to a ground-side feeding portion, and a signal received by the antenna conductor is taken out from a feeding portion, utilizing the ground-side feeding portion as a ground reference.

The antenna conductor is configured and dimensioned to have a function of receiving a frequency contained in a frequency band of 300 MHz to 2 GHz. In terms of having an improved antenna gain, the frequency band is preferably 400 MHz to 1 GHz, more preferably 400 MHz to 850 MHz, much more preferably 450 MHz to 820 MHz and most preferably 470 MHz to 770 MHz.

Now, the high frequency glass antenna for automobiles according to the present invention will be described in detail, based on preferred embodiments shown in accompanying drawings. FIG. 1 is a plan view showing the high frequency glass antenna for automobiles according to an embodiment of the present invention (seen from a car-interior side or a car-exterior side) and showing an upper right area of a rear window glass sheet for automobiles. In the following explanation, upper, lower, right and left directions are referred to, based on the respective directions on the drawings, unless otherwise specified.

In FIG. 1, reference symbol 1 designates an antenna conductor, reference symbol 2 designates a feeding portion for the antenna conductor, reference symbol 5*a* designates a right bus bar, reference symbol 7 designates heating wires, reference symbol 7*a* designates a highest heating wire, reference symbol 8 designates a short-circuit line disposed as needed, reference symbol 9 designates a ground-side feeding portion, reference symbol 10 designates a vehicle opening edge for a window, reference symbol 12 designates a connection conductor for a defogger, and reference symbol 14 designates a rear window glass sheet. The vehicle opening edge for a window is a peripheral edge of a vehicle opening, into which the rear window glass sheet 14 is fitted, and which serves as body grounding and is formed of a conductive material, such as metal.

In the embodiment shown in FIG. 1, an electric heating defogger, which includes the plurality of heating wires 7 and a plurality of bus bars for feeding the heating wires 7, is disposed on or in the rear window glass sheet 14 of an automobile. The rear window glass sheet 14 has the antenna conductor 1 and the feeding portion 2 disposed on or in an upper blank space thereof except for an area where the defogger is disposed. The defogger includes the ground-side feeding portion 9. A signal received by the antenna conductor 1 is taken out from a feeding portion, utilizing the ground-side feeding portion 9 as a ground reference, and is transmitted to a receiver (not shown).

Figure 3:
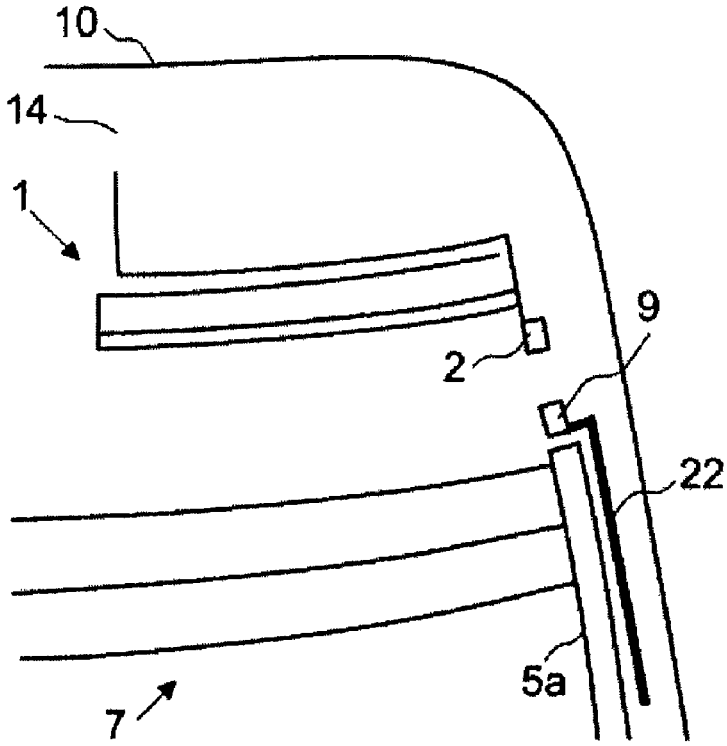
FIG. 3 is a ground-side feeding portion according to a different mode.

In the embodiment shown in FIG. 1, the ground-side feeding portion 9 is connected through the connection conductor 12 for a defogger to the bus bar 5*a* in terms of direct-current. However, the present invention is not limited to this embodiment. The ground-side feeding portion 9 may be disposed in the bus bar closest to the feeding portion 2 without disposing the connection conductor for a defogger 12 (A mode where the connection conductor 12 for a defogger has such a length set at 0 (zero) that the ground-side feeding portion is disposed in the bus bar 5*a* per se in FIG. 1). As shown in FIG. 3, the ground-side feeding portion 9 may be connected to a capacitively-coupling conductor 22 for a defogger, the capacitively-coupling conductor 22 for a defogger may have such a conductor length to serve as a transmission path for a desired frequency band and be disposed so as to be close to the defogger for capacitive coupling, and the ground-side feeding portion 9 may be electrically connected to the defogger through such capacitive coupling. When the ground-side feeding portion 9 is electrically connected to the defogger in terms of direct-current, measures, such as the provision of a capacitor, are taken as needed in order to prevent direct-current from flowing into the receiver.

Heretofore, since a defogger has an adverse effect to the reception sensitivity of an antenna conductor, it has been required that the antenna conductor 1 and the highest heating wire 7*a* be disposed to be far away from each other, or that the highest heating wire 7*a*, which is disposed just under the antenna conductor 1, be formed in a meander shape to reduce the adverse effect of the defogger. On the other hand, in accordance with this embodiment, the ground-side feeding portion 9 is electrically connected to the defogger in such a way that the defogger, which has an adverse effect to the antenna conductor, is positively utilized as a grounding conductor. This arrangement prevents the defogger from having an adverse effect on the antenna conductor 1 since the defogger serves as such a grounding conductor. Since the defogger does not need to change its shape, it is possible not only to provide the defogger with good appearance but also to effectively make a full use of a limited upper blank space in the rear window glass sheet 14.

In this embodiment, the antenna conductor 1 and the highest heating wire 7*a* have an average distance therebetween set at a value of preferably 10 to 80 mm, more preferably 15 to 60 mm in terms of having an improved antenna gain.

Figure 2:
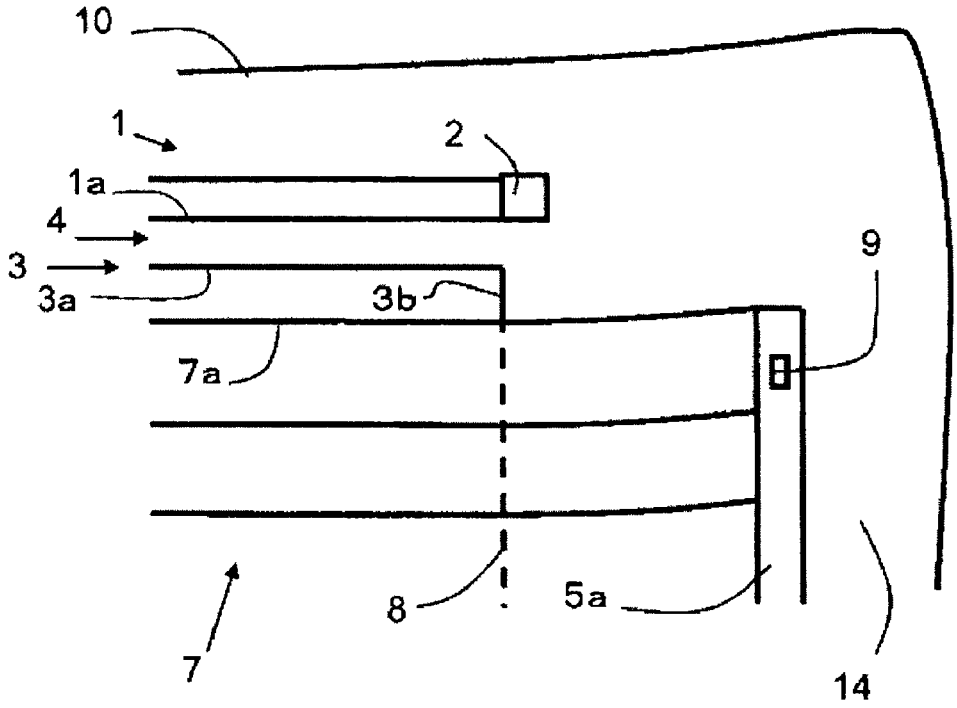
FIG. 2 is a plan view showing a second embodiment of the present invention.

Next, a second embodiment of the present invention will be described. FIG. 2 is a plan view showing the high frequency glass antenna for automobiles according to this embodiment of the present invention.

Explanation of the elements similar to those shown in FIG. 1 among the elements shown in FIG. 2 will be omitted. Reference symbol 1*a* designates a capacitively-coupling portion of an antenna conductor, reference symbol 3 designates a capacitively-coupling conductor, reference symbol 3*a* designates a capacitively-coupling portion of the capacitively-coupling conductor, reference symbol 3*b* designates an attaching portion of the capacitively-coupling conductor, and reference symbol 4 designates a capacitively-coupling area.

The present invention makes use of the defogger as the grounding conductor, and the defogger have a significantly larger conductor area than the antenna conductor 1. For this reason, even if the shape of the antenna conductor 1 changes, it is difficult to improve the reception sensitivity, and it is difficult to perform tuning for improvements in performance. In accordance with the present invention, by connecting an adjusting element to the defogger serving as the grounding conductor, it is possible to easily modify the reception sensitivity and to easily perform tuning. In the embodiment shown in FIG. 2, an typical example of the adjusting element will be described in detail.

In this embodiment, the capacitively-coupling conductor 3 is attached to the highest heating wire 7*a*, and the antenna conductor 1 and the capacitively-coupling conductor 3 are capacitively-coupled by being disposed so as to be close to each other with a certain distance. By changing the proximity distance between the antenna conductor 1 and the capacitively-coupling conductor 3 or the connection position of the capacitively-coupling conductor 3 to the highest heating wire 7*a*, it is possible to easily modify the reception sensitivity. The present invention is not limited to this embodiment. The capacitively-coupling conductor 3 may be attached to a portion of the defogger (such as, the bus bar 5*a*).

The portion of the antenna conductor 1 capacitively coupled to the capacitively-coupling conductor is called the capacitively-coupling portion 1*a* of the antenna conductor. The capacitively-coupling conductor 3 includes the capacitively-coupling portion 3*a* of the capacitively-coupling conductor capacitively coupled to the antenna conductor and the attaching portion 3*b* of the capacitively-coupling conductor where the capacitively-coupling portion 3*a* of the capacitively-coupling conductor is attached to the defogger. The area between the capacitively-coupling portion 1*a* of the antenna conductor and the capacitively-coupling portion 3*a* of the capacitively-coupling conductor in a rear window glass sheet 14 is called a capacitively-coupling area 4.

In this embodiment, the antenna conductor 1 and the defogger have an average distance of preferably 0.1 to 35 mm, more preferably 0.1 to 30 mm, much more preferably 2 to 10 mm therebetween in the capacitively-coupling area 4 in terms of obtaining an improved antenna gain.

When a desired frequency band has a center frequency having a wavelength of $\lambda_0$ in the air, glass has a shortening coefficient of wavelength of k, the formula of k=0.64 is established, and the formula of $\lambda_g=\lambda_0 \cdot k$ is established, it is preferred in terms of obtaining an improved antenna gain that the conductor length of a portion of a heating wire 7, which extends from the joint between the capacitively-coupling conductor 3 and the heating wire to the bus bar closest to the joint, be set at $(1/8)\cdot(\lambda_g/4)$ to $(5/4)\cdot(\lambda_g/4)$. In the embodiment shown in FIG. 2, the conductor length means the conductor length of the heating wire 7*a*, which extends from the bus bar 5*a* to the joint between the attaching portion 3*b* of the capacitively-coupling conductor and the highest heating wire 7*a*.

The conductor length of a portion of such a heating wire 7, which extends from the joint between the capacitively-coupling conductor 3 and such a heating wire 7 to the bus bar closest to the joint is preferably $(1/4)\cdot(\lambda_g/4)$ to $(\lambda_g/4)$, most preferably $(1/2)\cdot(\lambda_g/4)$ to $(3/4)\cdot(\lambda_g/4)$. Specifically, the conductor length is preferably 10 to 100 mm, more preferably 20 to 80 mm, most preferably 40 to 60 mm.

When the capacitively-coupling conductor 3 electrically connects between the antenna conductor 1 and the defogger, it is preferred in terms of obtaining an improved antenna gain that a short-circuit line 8 be disposed to extend so as to traverse at least two of the plurality of heating wires, starting at the joint between the capacitively-coupling conductor 3 and such a heating wire 7. However, the present invention is not limited to this mode. It is preferred in terms of obtaining an improved antenna gain that the distance from the joint between the highest heating wire 7*a* and the short-circuit line 8 to the portion where the capacitively-coupling conductor 3 is attached to the highest heating wire 7*a* be $0.323\cdot\lambda_0\cdot k$ or less, in particular $0.097\cdot\lambda_0\cdot k$ or less.

For the same reason, it is preferred that the short-circuit line 8 extend in a vertical direction or a substantially vertical direction. Further, a similar short-circuit line may be disposed to extend so as to traverse at least two of the plurality of heating wires in an area opposed to the bus bar 5*a* with respect to the short-circuit line 8.

In general, antenna conductors for receiving a radio wave in a high frequency band, such as a digital television broadcast band, have a shorter conductor length than antenna conductors for receiving a radio wave in an AM broadcast band or an FM broadcast band. Since defoggers have heating conductive wires extending in right and left directions by such a long length that the defoggers are not suitable to be employed for receiving a digital television broadcast band without modification, the defoggers have not been made use of. By using a short-circuit line to divide heating wires so as to virtually reduce the conductor length of the heating wires in accordance with the present invention, it is possible to have an improved antenna gain.

In the embodiment shown in FIG. 2, the capacitively-coupling portion 3*a* of the capacitively-coupling conductor is disposed so as to extend in a direction away from the feeding portion 2, seen from the joint between the capacitively-coupling portion 3*a* of the capacitively-coupling conductor and the attaching portion 3*b* of the capacitively-coupling conductor. It is preferred in terms of having an improved antenna gain that the capacitively-coupling portion 3*a* of the capacitively-coupling conductor have a portion extending in a direction away from the feeding portion 2, seen from the joint between the capacitively-coupling portion 3*a* of the capacitively-coupling conductor and the attaching portion 3*b* of the capacitively-coupling conductor as described above.

Furthermore, it is preferred in terms of having an improved antenna gain that the capacitively-coupling portion 1*a* of the antenna conductor and/or the capacitively-coupling portion 3*a* of the capacitively-coupling conductor have a maximum width of 50 to 150 mm, in particular 70 to 120 mm in the right and left directions.

Figure 4:
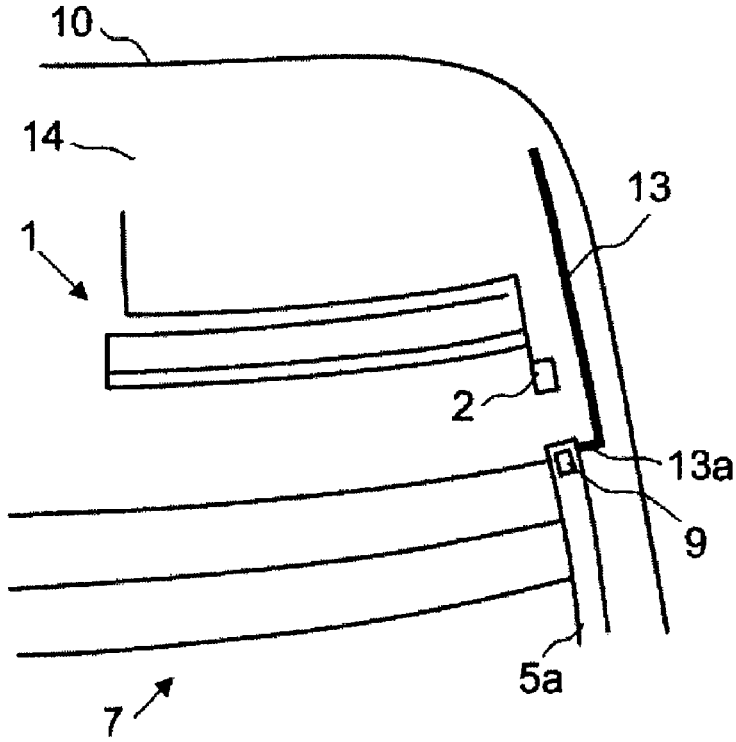
FIG. 4 is a plan view showing a third embodiment of the present invention.

Next, a third embodiment of the present invention will be described. FIG. 4 is a plan view showing the high frequency glass antenna for automobiles according to one embodiment of the present invention.

Explanation of elements similar to those shown in FIG. 1 among the elements shown in FIG. 4 will be omitted. Reference symbol 13 designates an upwardly extending element, reference symbol 13*a* designates an attaching portion of the upwardly extending element. Although the antenna conductor 1 according to this embodiment has a different shape from the one shown in FIG. 1, the antenna conductor 1 according to this embodiment may be formed in a similar shape to the antenna conductor 1 shown in FIG. 1 since it is sufficient that the antenna conductor 1 according to the present invention is formed in such a shape to be suitable for receiving a radio wave in a desired frequency band.

Explanation in detail of this embodiment will be made about one embodiment where the defogger is made use of as a grounding conductor as in the second embodiment shown in FIG. 2 and the upwardly extending element 13 functions as the adjusting element.

The upwardly extending element 13 extends upwardly through the attaching portion 13*a* of the upwardly extending element, which extends from a portion of a bus bar 5*a* close to its upper end toward an opposite direction of the heating wires. It is possible to easily modify the reception sensitivity and easily perform tuning operation by adjusting the conductor length of the upwardly extending element 13. It is preferred in terms of having an improved antenna gain that the upwardly extending element 13 extends upwardly along a vehicle opening edge 10. In this embodiment, when a desired frequency band has a center frequency having a wavelength of $\lambda_0$ in the air, glass has a shortening coefficient of wavelength of k, the formula of k=0.64 is established, and the formula of $\lambda_g=\lambda_0\cdot k$ is established, the upwardly extending element 13 has a conductor length of preferably $(7/8)\cdot(\lambda_g/4)$ to $(15/8)\cdot(\lambda_g/4)$, more preferably $(7/8)\cdot(\lambda_g/4)$ to $(7/4)\cdot(\lambda_g/4)$, further preferably $(\lambda_g/4)$ to $(3/2)\cdot(\lambda_g/4)$ in terms of obtaining an improved antenna gain.

Furthermore, the upwardly extending element 13 has a conductor length set at preferably 70 to 150 mm, more preferably 70 to 140 mm, much more preferably 80 to 120 mm in terms of having an improved antennal gain. When the attaching portion 13*a* of the upwardly extending element has a negligible effect because of having a short conductor length as in the embodiment shown in FIG. 4, only the length of the upwardly extending conductor of the upwardly extending element 13 may be taken into account in determination of the length.

This embodiment is not limited to the mode shown in FIG. 4. The upwardly extending element 13 may extends upwardly from a portion of the bus bar 5*a* close to its center or its lower end in the vertical direction of the bus bar. In such a case, the upwardly extending element may be disposed closely to the bus bar 5*a* so as to be capacitively-coupled to the bus bar as needed. Although a feeding portion 2 is disposed just above the bus bar 5*a* in the embodiment shown in FIG. 4, the upwardly extending element 13 may be disposed so as to extend upwardly directly from the upper end of the bus bar 5*a* without provision of the attaching portion 13*a* of the upwardly extending element in a case where the feeding portion 2 is disposed in a different area so as to provide a blank area just above the bus bar 5*a*.

Figure 5:
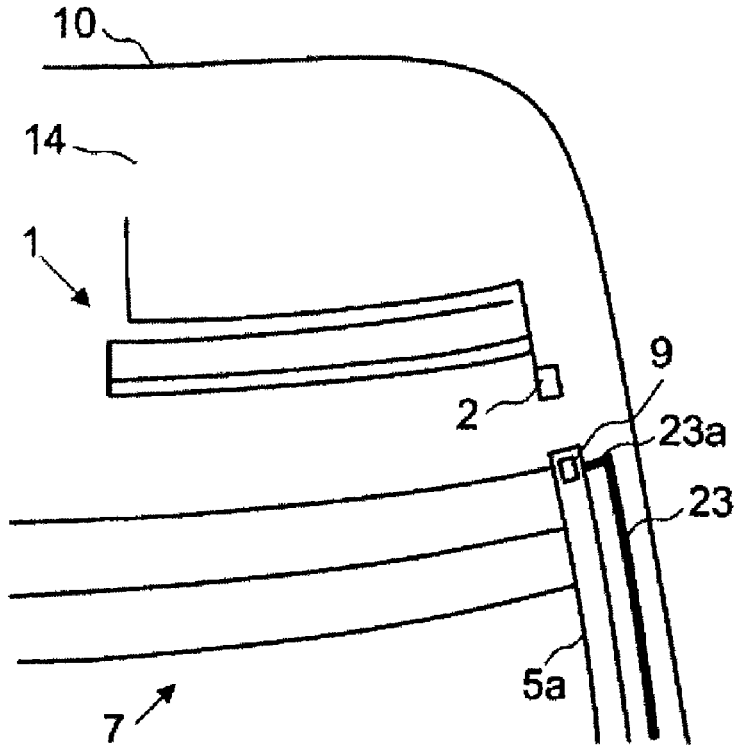
FIG. 5 is a plan view showing a fourth embodiment of the present invention.

Next, a fourth embodiment of the present invention will be described. FIG. 5 is a plan view showing the high frequency glass antenna according to one embodiment of the present invention. Explanation of the elements similar to those shown in FIG. 4 among the elements shown in FIG. 5 will be omitted. Reference symbol 23 designates a downward capacitively-coupling element, and reference symbol 23*a* designates an attaching portion of the downward capacitively-coupling element.

Explanation in detail of this embodiment will be made about one embodiment where the defogger is made use of as a grounding conductor as in the second embodiment shown in FIG. 2 and the downward capacitively-coupling element 23 functions as the adjusting element.

The downward capacitively-coupling element 23 is disposed so as to extend downwardly along a bus bar 5*a* through the attaching portion 23*a* of the downward capacitively-coupling element, which extends from a portion of the bus bar 5*a* close to its upper end toward an opposite direction of the heating wires. The downward capacitively-coupling element is disposed closely to the bus bar 5*a* so as to be capacitively-coupled to the bus bar. By adjusting the conductor length of the downward capacitively-coupling element 23, i.e. the length of the capacitive coupling, it is possible to easily modify the reception sensitivity and to easy perform tuning operation. The downward capacitively-coupling element 23 extends downwardly along a vehicle opening edge 10, which is preferred in terms of obtaining an improved antenna gain.

In this embodiment, a desired frequency band has a center frequency having a wavelength of $\lambda_0$ in the air, glass has a shortening coefficient of wavelength of k, the formula of k=0.64 is established, and the formula of $\lambda_g=\lambda_0 \cdot k$, the downward capacitively-coupling element 23 has a conductor length of preferably $(7/8)\cdot(\lambda_g/4)$ to $(15/8)\cdot(\lambda_g/4)$, more preferably $(7/8)\cdot(\lambda_g/4)$ to $(7/4)\cdot(\lambda_g/4)$, further preferably $(\lambda_g/4)$ to $(3/2)\cdot(\lambda_g/4)$ in terms of obtaining an improved antenna gain.

Furthermore, the downward capacitively-coupling element 23 has a conductor length set at preferably 70 to 150 mm, more preferably 70 to 140 mm, much more preferably 80 to 120 mm in terms of obtaining an improved antennal gain. With regard to the conductor length, only the length of a downwardly extending conductor of the downward capacitively-coupling element 13 is taken into account since the attaching portion 23*a* of the downward capacitively-coupling element has a negligible effect because of having a short conductor length. This embodiment is not limited to the mode shown in FIG. 5. The downward capacitively-coupling element 23 may extends downwardly from a portion of the bus bar 5*a* close to its center in a vertical direction of the bus bar.

Figure 6:
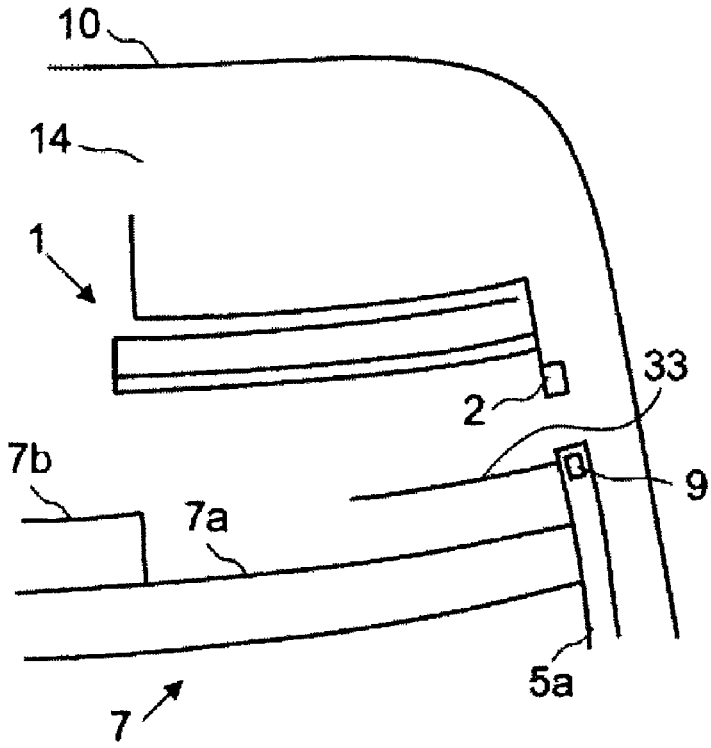
FIG. 6 is a plan view showing a fifth embodiment of the present invention.

Next, a fifth embodiment of the present invention will be described. FIG. 6 is a plan view showing the high frequency glass antenna for automobiles according to one embodiment of the present invention. Explanation of the elements similar to those shown in FIG. 1 among the elements shown in FIG. 6 will be omitted. Reference symbol 33 designates a laterally extending element, reference symbol 7*a* designates a highest heating wire, and reference symbol 7*b* designates a convex shape heating wire. The highest heating wire 7*a* is located at the highest position among the heating wires 7 connected to a bus bar 5*a*, and the convex shape heating wire 7*b* has a raised figure, which connected to the highest heating wire 7*a* at positions away from the bus bar 5*a*. The bus bar 5*a* extends upwardly beyond a portion thereof where the highest heating wire 7*a* is connected to the bus bar.

Explanation in detail of this embodiment will be made about one embodiment where the defogger is made use of as a grounding conductor as in the second embodiment shown in FIG. 2 and the laterally extending element 13 functions as the adjusting element.

The laterally extending element 33 is disposed so as to extend toward a heating wire side from a portion of the bus bar 5*a*, which is close to its upper end and above the joint with the highest heating wire 7*a*. By adjusting the conductor length of the laterally extending element 33, it is possible to easily modify the reception sensitivity and to easily perform tuning operation. The laterally extending element 33 is preferably disposed so as to extend parallel with or substantially parallel with the heating wires 7 in order to be prevented from having a poor appearance.

In this embodiment, a desired frequency band has a center frequency having a wavelength of $\lambda_0$ in the air, glass has a shortening coefficient of wavelength of k, the formula of k=0.64 is established, the laterally extending element 13 has a conductor length set at preferably $(5/8)\cdot(\lambda_g/4)$ to $(19/16)\cdot(\lambda_g/4)$, more preferably $(3/4)\cdot(\lambda_g/4)$ to $(19/16)\cdot(\lambda_g/4)$, further preferably $(13/16)\cdot(\lambda_g/4)$ to $(9/8)\cdot(\lambda_g/4)$ in order to have an improved antenna gain. The laterally extending element 13 has a conductor length of preferably 50 to 95 mm, more preferably 60 to 95 mm, much more preferably 65 to 90 mm in order to obtain an improved antenna gain.

In the present invention, one of the above-mentioned embodiments may be combined with another one of the embodiments. In other words, the high frequency glass antenna for automobiles may include a plurality of elements selected among the capacitively-coupling conductor 3, the upwardly extending element 13, the downward capacitively-coupling element 23 and the laterality extending element, or all of such elements.

A main portion of the antenna conductor 1, starting at the feeding portion 2, extends in a direction to be remote from the ground-side feeding portion 9. The main portion of the antenna conductor 1 means a portion of the antenna conductor 1 that occupies 70% or more of the entire conductor length of the antenna conductor 1.

Preferably, the defogger includes at least one bus bar in each of a left-hand area and a right-hand area of the rear window glass sheet 14 in order to defog a central area of the rear window glass sheet 14 for ensuring a good sight. For the same reason, it is preferred that these two bus bars be disposed so as to extend vertically or substantially vertically, that these two bus bars be connected by the plurality of heating wires 7, and that the plurality of heating wires 7 be disposed so as to extend horizontally or substantially horizontally. It is preferred in terms of mounting convenience that the antenna conductor 1 be disposed so as to close to one of these two bus bars.

In the present invention, each of the feeding portion 2 and the ground-side feeding portion 9 (except for the one disposed the defogger per se) has an area of preferably 49 to 400 $mm^2$, more preferably 81 to 225 $mm^2$ in terms of mounting convenience. The feeding portion 2 and the ground-side feeding portion 9 have a distance of preferably 5 to 100 mm, more preferably 10 to 80 mm therebetween in terms of mounting convenience.

In the present invention, it is preferred in terms of obtaining an improved antenna gain that a desired frequency band have a center frequency having a wavelength of $\lambda_0$ in the air. For receiving the entire digital terrestrial television broadcasts in Japan, it is preferred that $\lambda_0$ be a wavelength in the air at a frequency of 620 MHz. For receiving the broadcast range of the current digital terrestrial television broadcasts in Japan (470 to 600 MHz), it is preferred that $\lambda_0$ be a wavelength in the air at a frequency of 535 MHz. For receiving a main range of the terrestrial television broadcasts in Japan (470 to 710 MHz), it is preferred that $\lambda_0$ be a wavelength in the air at a frequency of 590 MHz.

When a coaxial cable (not shown) is employed to send a receipt signal to a receiver in the present invention, the center conductor of the coaxial cable is connected to the feeding portion 2, and the outer conductor of the coaxial cable is connected to the ground-side feeding portion 2. The coaxial cable is connected to an input end of the receiver. The way for connecting the coaxial cable to the feeding portion 2 and the ground-side feeding portion 9 is not limited to direct connection by, e.g. soldering. The connection may be made by using a connector.

When a signal received by the antenna conductor 1 is sent to the receiver through an peripheral circuit for an antenna, the peripheral circuit for an antenna has one of two inputs connected to the feeding portion 2 and the other input connected to the ground-side feeding portion 9. The peripheral circuit for an antenna has one of two outputs connected to an input of the receiver and the other output connected to a grounding terminal of the receiver. The peripheral circuit for an antenna is preferably mounted to a car-interior-side of the rear window glass sheet 14 in terms of obtaining a improved S/N ratio.

The present invention may be configured so that the rear window glass sheet 14 has a light-shielding film as a dielectric film disposed thereon, and that a portion or the entire portion of at least one selected among the antenna conductor 1, the feeding portion 2, the defogger and the ground-side feeding portion 9 is disposed on the light-shielding film. The light-shielding film is made of, e.g. a ceramic material, such as a dark ceramic film. In this case, since elements, such as the antenna conductor 1, which are disposed on the light-shielding film, are at least partly concealed by the light-shielding film as seen from a car-exterior side of the rear window glass sheet 14, the rear window glass sheet 14 has such an excellent design that the antenna device according to the present invention is not noticeable.

Each of the antenna conductor 1, the feeding portion 2, the ground-side feeding portion 9 and the defogger may be formed by printing paste containing conductive metal, such as silver paste, on the car-interior-side of the rear window glass sheet 14 and baking the printed paste. However, the present invention is not limited to this forming method. A linear member or foil member, which is formed of a conductive substance, such as copper, may be formed on the car-interior-side or the car-exterior-side of the rear window glass sheet 14 or in the rear window glass sheet 14 per se. A plastic film, which has a conductive layer formed therein or thereon, may be disposed on the car-interior-side or the car-exterior-side of the rear window glass sheet such that respective sections of the conductive layer serve as the antenna conductor 1 and the feeding portion 2.

EXAMPLE

Now, although the present invention will be described in detail with reference to examples, the present invention is not limited to these examples. Various modifications or changes may be made without departing from the spirit and scope of the present invention. Now, some examples will be described in detail in reference to drawings.

Case 1 (Example)

Figure 7:
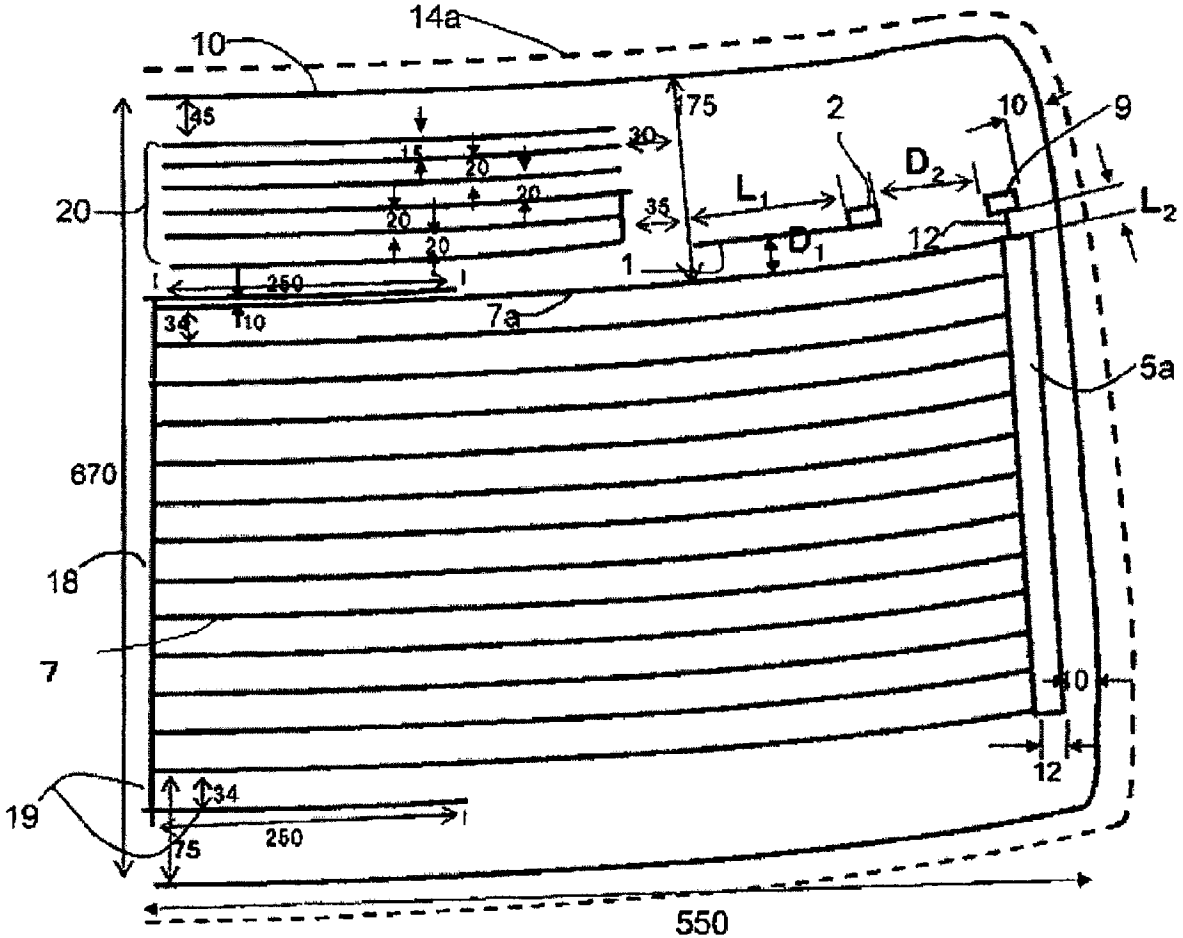
FIG. 7 is a plan view showing the example of Case 1.

A high frequency glass antenna for automobiles, which made use of a rear window glass sheet mounted to an automobile, was fabricated as shown in FIG. 7 (seen from a car-interior side), and antenna gains were measured. The case shown in FIG. 7 is a case where a defogger had a bus bar 5*a* connected to a ground-side feeding portion 9 without connection of an adjusting element. Reference symbol 18 designates a central short-circuit line in a right-to-left direction, reference symbol 19 designates conductors for adjusting the receiving performance in an FM broadcast band, which is not directly related to this embodiment, reference symbol 20 designates antenna conductors for AM and FM broadcast bands, which are not directly related to this embodiment, reference symbol 14*a* designates an outer edge of the rear window glass sheet, reference symbol $D_1$ designates the distance between an antenna conductor 1 and a highest heating wire 7*a*, reference symbol $D_2$ designates the distance between a feeding portion 2 and the ground-side feeding portion 9, reference symbol $L_1$ designates the length of a capacitive-coupling portion 1*a* of the antenna conductor (antenna conductor 1), and reference symbol $L_2$ designates the length of a connection conductor 12 for the defogger. The numerical figures close to arrows indicate dimensions in the unit of mm. The dimensions of the other portions are listed below.

$L_1$: 80 mm, $D_2$: 40 mm, Feeding portion 2 (longitudinal and width dimensions): 12×13 mm, Ground-side feeding portion 9 (longitudinal and width dimensions): 12×13 mm, Line width of antenna conductor 1: 0.7 mm, Line width of connection conductor 12 for defogger: 0.7 mm, Line width of antenna conductor 20: 0.7 mm, Line width of central short circuit line 18 in left-to-right direction: 1 mm, Line width of conductor 19 for adjusting receiving performance in FM broadcast band: 1 mm, Line width of respective heating wires 7: 1 mm.

The measurements were made for horizontally polarized waves at frequencies of every 6 MHz in a range of 473 to 767 MHz. The average antenna gain at such every frequency was found. The antenna gains were represented by antenna gain average values (every 3°) within −90° to +90° in the horizontal direction (automobile backside) when the rear of the automobile was set at 0 (zero)°, the right direction of the automobile was set at +90° and the front of the automobile was set at +180°. The rear window glass sheet 14 was forwardly slanted at an angle of 27° with respect to the horizontal direction.

Figure 8:
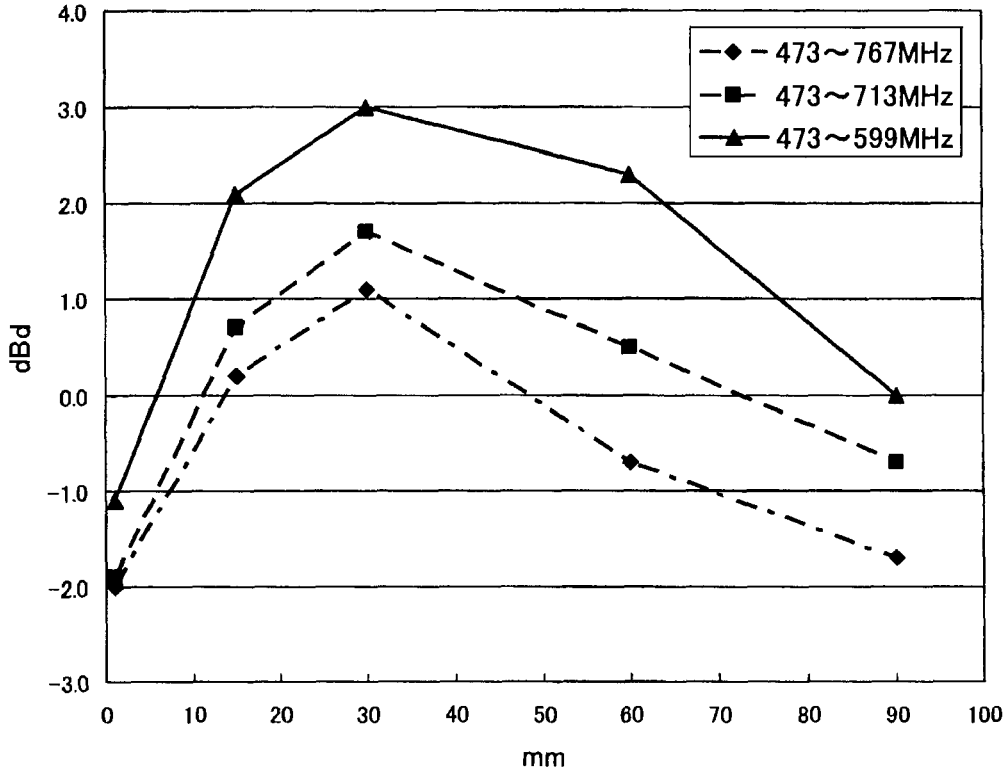
FIG. 8 is a characteristic graph showing the relationship between an antenna gain and the distance of a highest heating wire from an antenna in Case 1.

Further, the antenna gains in a range of 473 to 767 MHz, a range of 473 to 713 MHz and a range of 473 to 599 MHz were measured with each of the values of $D_1$ and $L_2$ being set at 1 mm, 15 mm, 30 mm, 60 mm and 90 mm, respectively, on this order. The measurement results are shown in FIG. 8. FIG. 8 is a characteristic graph showing the found antenna gains with respect to the distance between the antenna conductor and the highest heating wire wherein the horizontal axis represents the distance $D_1$ between the antenna conductor and the highest heating wire, and the vertical axis represents the found antenna gains. It was revealed that high antenna gains were obtained in a range of 473 to 599 MHz close to the priority bandwidth for digital terrestrial broadcasts, and that an excellent performance was obtained when the distance $D_1$ was in a range of 15 to 60 mm.

Case 2 (Example)

Figure 9:
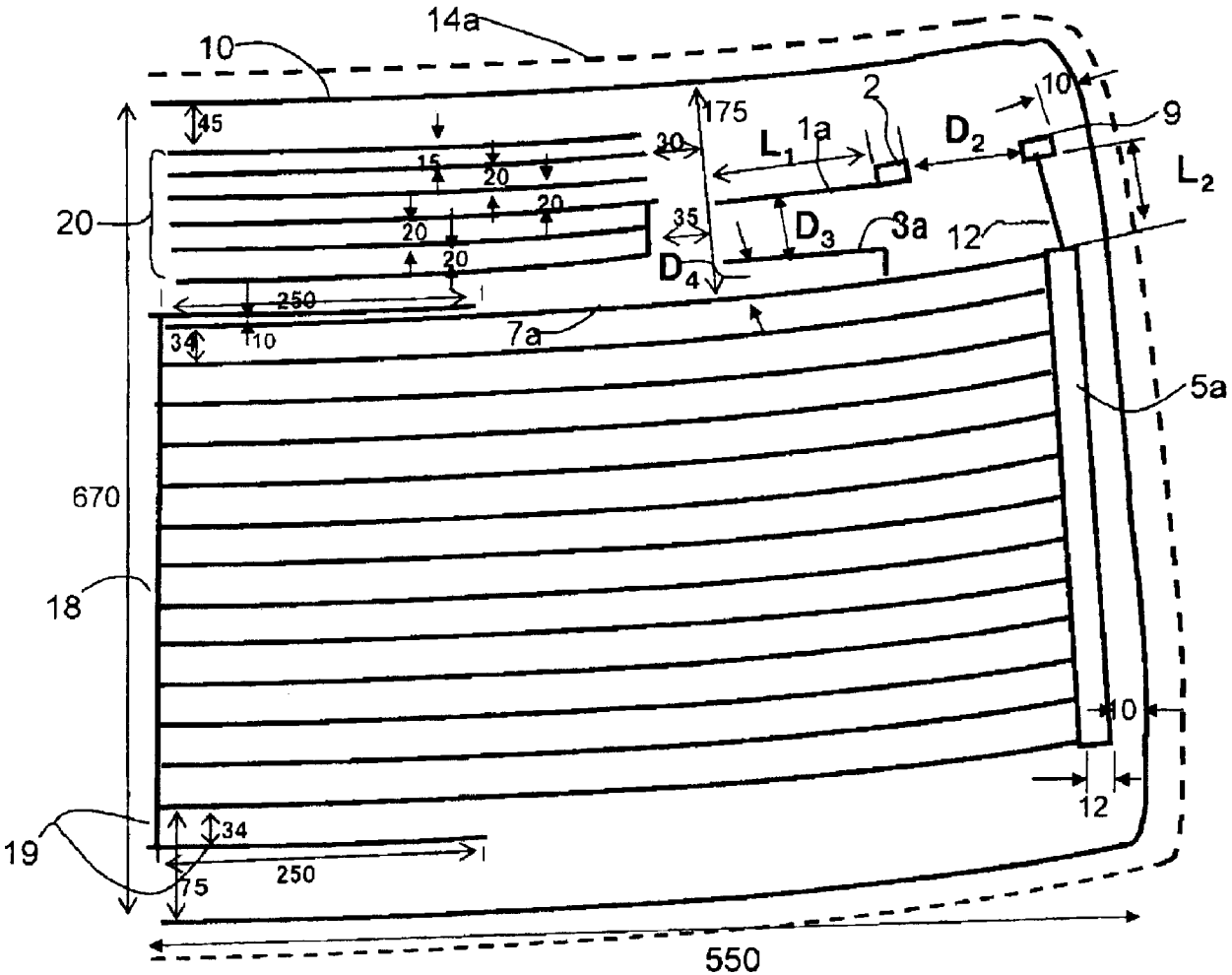
FIG. 9 is a plan view showing the example of Case 2.

A high frequency glass antenna for automobiles was fabricated as shown in FIG. 9 (seen from a car-interior-side) in a similar way to Case 1, and antenna gains were measured. The case shown in FIG. 9 is a case where a capacitively-coupling conductor as the adjusting element was connected to a highest heating wire. Reference symbol $D_3$ designates the distance between a capacitively-coupling portion 1*a* of an antenna conductor and a capacitively-coupling portion 3*a* of the capacitively-coupling conductor (wherein both extend in parallel), and reference symbol $D_4$ designates the distance between the capacitively-coupling portion 3*a* of the capacitively-coupling conductor and the highest heating wire 7*a* (wherein both extend in parallel). Numerical figures close to arrows designates dimensions in the unit of mm. The dimensions of the other elements are listed below. The dimensions that are not listed below are the same as the dimensions in Case 1.

Conductor length of capacitively-coupling portion 3*a* of capacitively-coupling conductor: 100 mM, $D_4$: 25 mm The measuring method was the same as Case 1. The antenna gains in a range of 473 to 767 MHz, a range of 473 to 713 MHz and a range of 473 to 599 MHz were measured with the value of $D_3$ being set at 1 mm, 5 mm, 35 mm and 65 mm, respectively. The distance $D_3$ was changed by upwardly moving an antenna conductor 1 (the capacitively-coupling portion 1*a* of the antenna conductor), a feeding portion 2 and a ground-side feeding portion 9. As the distance $D_3$ changed, the value of L2 was upwardly extended by the same distance accordingly.

Figure 10:
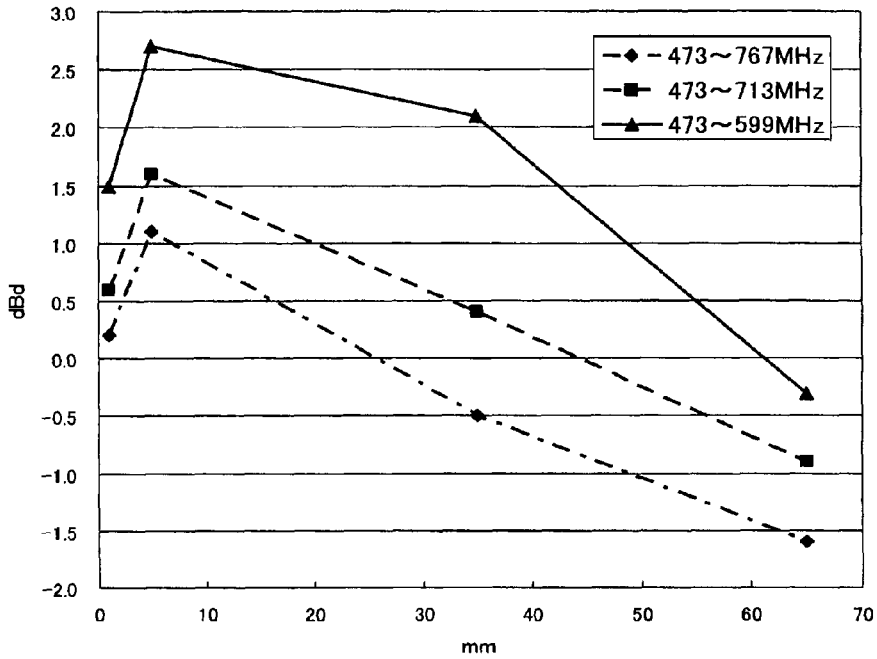
FIG. 10 is a characteristic graph showing the relationship between an antenna gain and the distance of a capacitively-coupling conductor from an antenna in Case 2.

The measurement results are shown in FIG. 10. FIG. 10 is a characteristic graph showing the found antenna gains with respect to the distance between the capacitively-coupling portion of the antenna conductor and the capacitively-coupling portion of the capacitively-coupling conductor wherein the horizontal axis represents the distance $D_3$ between the capacitively-coupling portion 1*a* of the antenna conductor and the capacitively-coupling portion 3*a* of the capacitively-coupling conductor, and the vertical axis represents the found antenna gains. It was revealed that high antenna gains were obtained in a range of 473 to 599 MHz close to the priority band width for digital terrestrial broadcast, and that an excellent performance was obtained when the capacitively-coupling conductor as the adjustment element was connected to the defogger while the capacitively-coupling conductor was capacitively-coupled to the antenna conductor by a reduction in the distance $D_3$. Since the antenna gains change by modifying the distance $D_3$, the antenna gains can be easily optimized.

Case 3 (Example)

Figure 11:
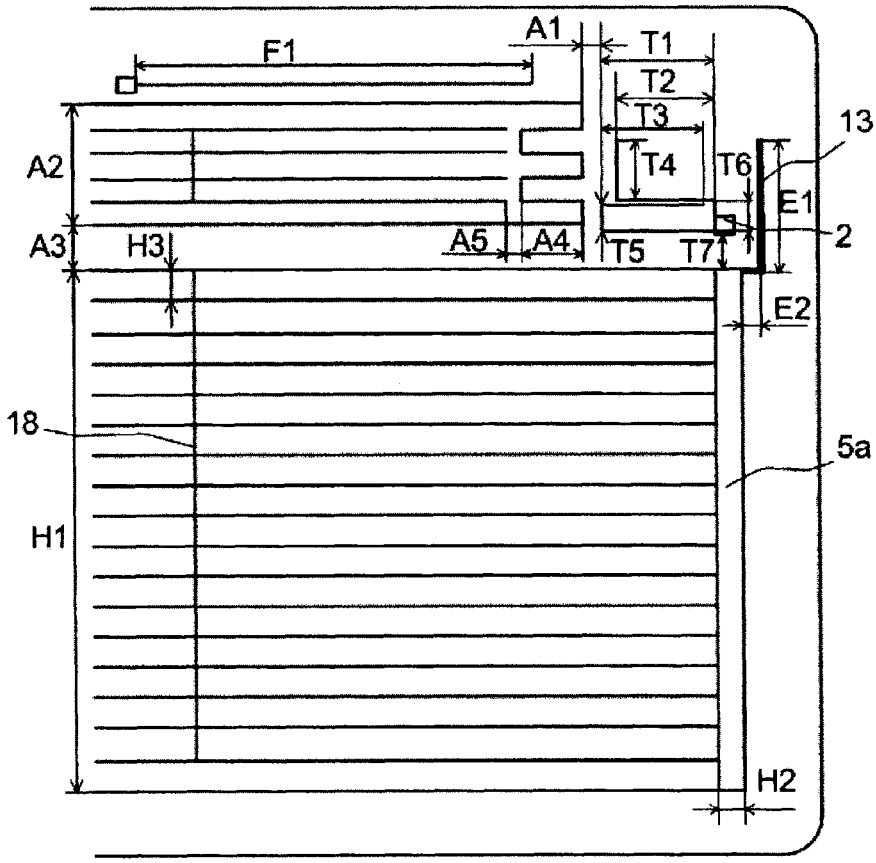
FIG. 11 is a plan view showing the example of Case 3.

A high frequency glass antenna for automobiles, which made use of a rear window glass sheet mounted to an automobile, was fabricated as shown in FIG. 11 (seen from a car-interior-side), and antenna gains were measured. In FIG. 11, in addition to a defogger and an antenna conductor for a digital terrestrial television, which is different from the one in Case 1, an antenna conductor for an AM broadcast and an antenna conductor for FM broadcast, which are not directly related to the present invention, were disposed on the rear window glass sheet in the same way as an actual automobile. An upwardly extending element 13 as the adjusting element was connected to a bus bar 5*a*. The center of the rear window glass sheet in the right-to-left direction lies on a short-circuit line 18 disposed in the defogger shown in FIG. 11. The dimensions of the respective parts are listed below.

T1: 165 mm, T2: 150 mm, T3: 155 mm, T4: 50 mm, T5: 20 mm, T6: 25 mm, T7: 33 mm, H1: 510 mm, H2: 13 mm, H3: 30 mm, A1: 20 mm, A2: 100 mm, A3: 40 mm, A4: 50 mm, A5: 10 mm, F1: 420 mm, E2: 10 mm, Line width of antenna conductor: 0.7 mm, Line width of antenna conductor for AM and FM broadcasts: 0.7 mm, Line width of respective heating lines 7: 1 mm, Conductor width of upwardly extending element 13: 3 mm The measurements were made for horizontally polarized waves at frequencies of every 6 MHz in a range of 473 to 575 MHz (the priority band width), and at frequencies of every 18 MHz in a range of 587 to 713 MHz (non-priority band width). The average antenna gain at such every frequency was found. Each of the average antenna gains was an average value of the antenna gains that were obtained by conducting the measurements at a back of the automobile with the automobile being rotated (at every 3°) within a range of −90° to +90° in the horizontal direction in a case where the back of the automobile was set at 0 (zero)°, the right direction of the automobile was set at +90° and the front of the automobile was set at +180°.

Figure 12:
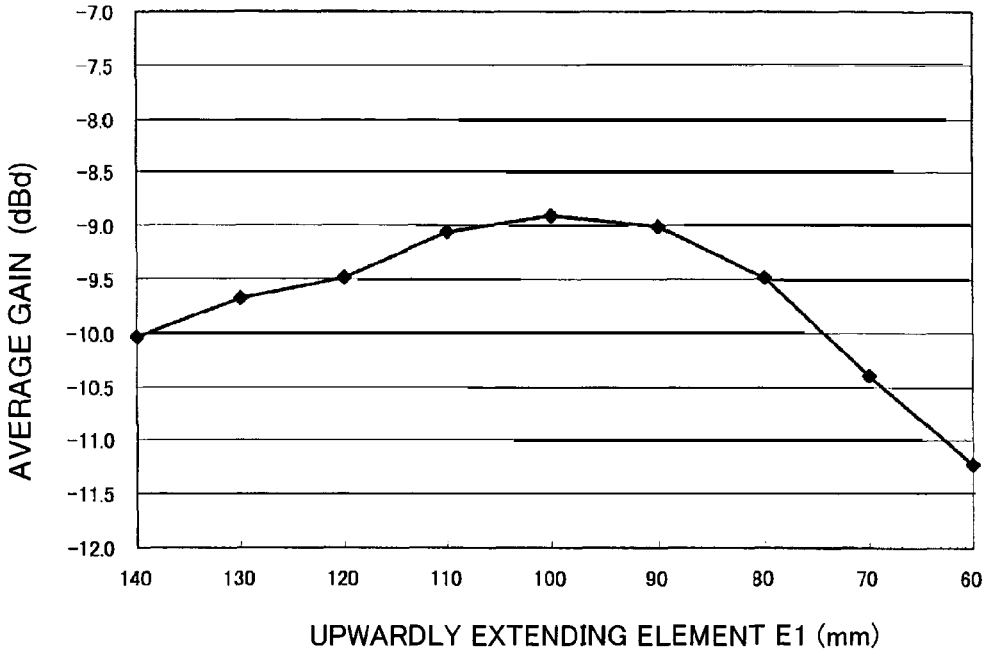
FIG. 12 is a characteristic graph showing the relationship between an antenna gain and the length of an upwardly extending element in Case 3.

In FIG. 11, the above-mentioned measurements were made with the value of the conductor length E1 of the upwardly extending element 13 in a longitudinal direction being modified at every 10 mm in a range of 60 to 140 mm, and the results of the measurements are shown in FIG. 12. In this figure, the horizontal axis represents the conductor length of the upwardly extending element in the longitudinal direction, and the vertical axis represents the found antenna gains. As clearly shown in FIG. 12, the antenna had an excellent performance when the upwardly extending element had a length set at 80 to 140 mm. It is possible to easily optimize the antenna gains since the antenna gains are changed by modifying the length of the upwardly extending element.

Case 4 (Example)

Figure 13:
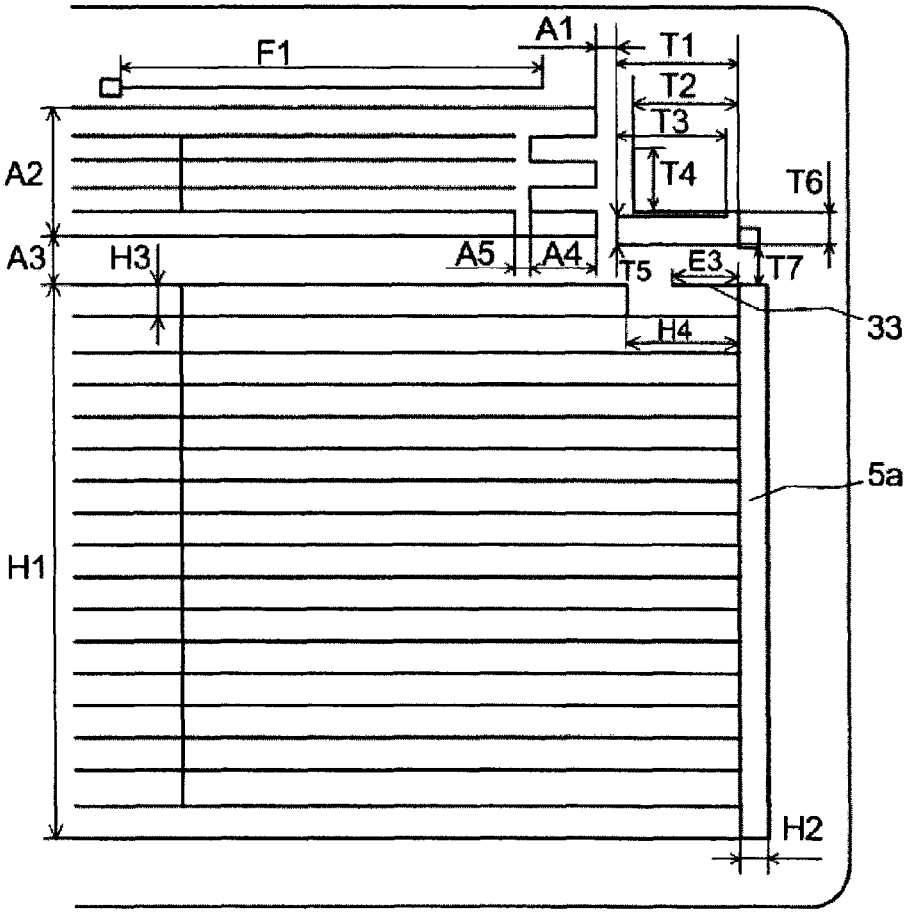
FIG. 13 is a plan view showing the example of Case 4.

As in Case 3, an antenna conductor for a digital terrestrial television, a defogger, an antenna conductor for an AM broadcast band and an antenna conductor for an FM broadcast band were disposed on a rear window glass sheet as shown in FIG. 13, and a lateral extending element 33 as the adjusting element was connected to a bus bar 5*a*. The dimensions of the respective parts were the same as the ones in Case 3 except for the one shown below.

H4: 150 mm

Figure 14:
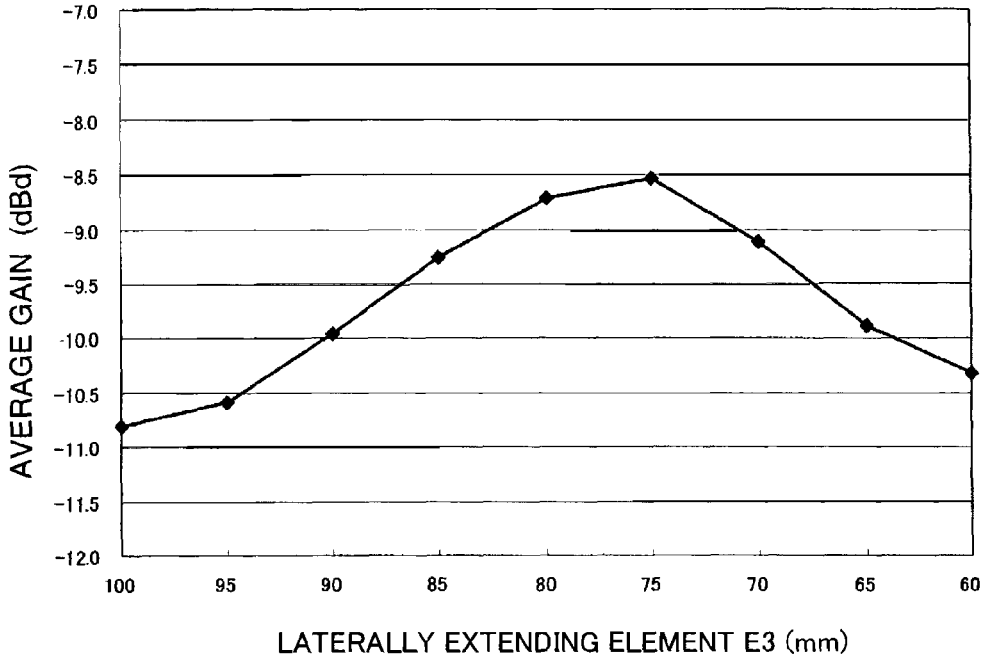
FIG. 14 is a characteristic graph showing the relationship between an antenna gain and the length of a laterally extending element in Case 4.

The measurements were made in a similar way to Case 3. In FIG. 13, the measurements were made with the value of the conductor length E3 of the lateral extending element 33 being modified at every 5 mm in a range of 60 to 100 mm. The results of the measurements are shown in FIG. 14. In this figure, the horizontal axis represents the conductor length of the lateral extending element, and the vertical axis represents the found antenna gains. As clearly shown in FIG. 14, the antenna had an excellent performance when the lateral extending element had a length set at 65 to 90 mm. It is possible to easily optimize the antenna gains since the antenna gains are changed by modifying the length of the lateral extending element.

Case 5 (Example)

Figure 15:
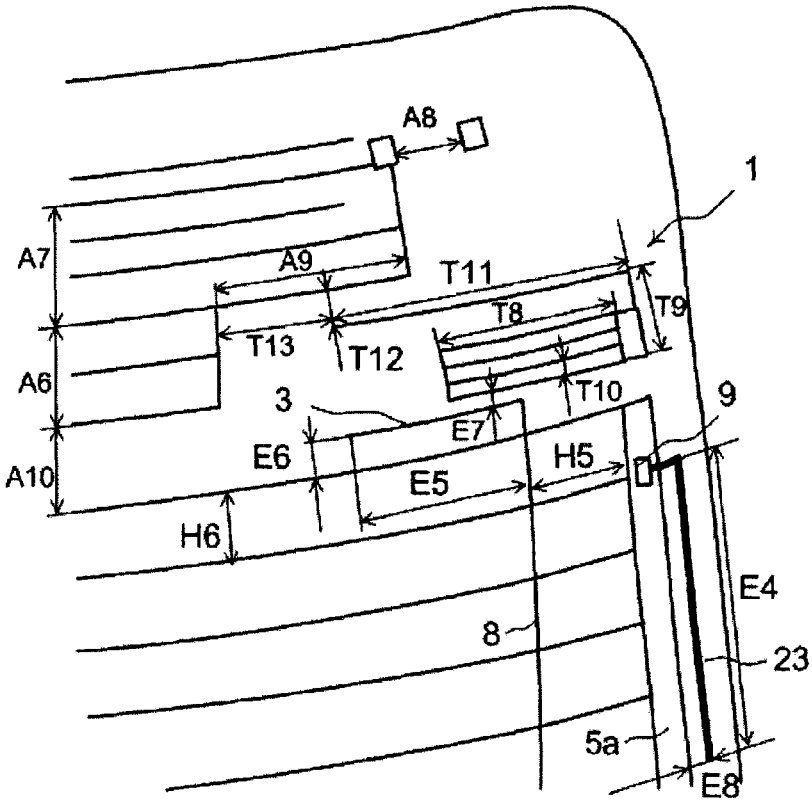
FIG. 15 is a plan view showing the example of Case 5.

A high frequency glass antenna for automobiles, which made use of a rear window glass sheet mounted to an automobile, was fabricated as shown in FIG. 15 (seen from a car-interior side), and antenna gains were measured. An antenna conductor for an AM/FM broadcast band, which was not directly related to the present invention, was also disposed. In FIG. 15, a capacitively coupling conductor 3 as the adjusting element was also disposed in proximity to an antenna conductor 1 for a digital terrestrial television band, and a short-circuit line 8 was disposed in the heating wires. Additionally, a downward capacitive-coupling element 23 was connected to a bus bar 5*a*. The dimensions of the respective parts are listed below.

E4: 105 mm, E5: 100 mm, E6: 25 mm, E7: 5 mm, E8: 5 mm, T8: 90 mm, T9: 25 mm, T10 (which also applies to the distance between upper two conductors adjacent to the antenna conductor 1): 5 mm, T11: 130 mm, T12: 15 mm, T13: 50 mm, H5: 50 mm, H6: 35 mm, A6: 40 mm, A7: 50 mm, A8: 40 mm, A9: 65 mm, A10: 35 mm, Line width of antenna conductor: 0.7 mm, Line width of antenna conductor for AM/FM broadcasts: 0.7 mm, Line width of respective heating lines 7: 1 mm, Conductor width of downward capacitively-coupling element 23: 3 mm, Feeding portion of antenna conductor 1: 15×13 mm, Feeding portion of antenna conductor for AM/FM broadcast band: 12×12 mm, Width of capacitively-coupling portion between capacitively-coupling conductor 3 and antenna conductor 1: 45 mm The measurements were made for horizontally polarized waves at frequencies of every 6 MHz in a range of 473 to 713 MHz, and the average antenna gain was found at such every frequency. The other conditions were the same as Case 1.

In FIG. 15, the measurements were made for both of a case where a ground-side feeding portion 9, which was electrically connected to a defogger, was connected to a ground-side terminal of a receiver (example) and a case where the ground-side feeding portion 9 was not connected to the ground-side terminal (comparative example). The results of measurements are shown in FIG. 16.

Figure 16:
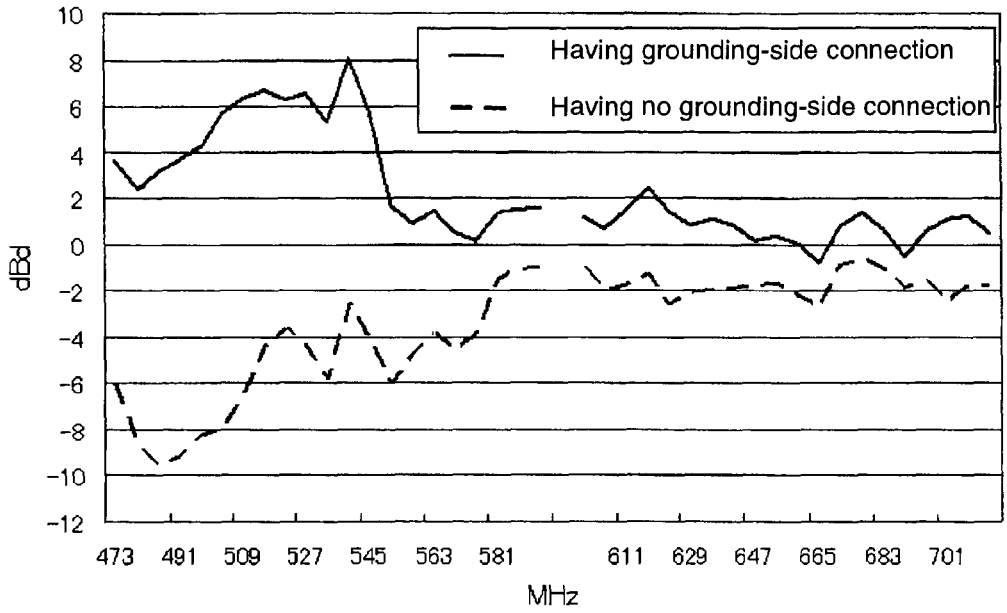
FIG. 16 is a characteristic graph showing the relationship between an antenna gain and a frequency with respect to the presence and absence of connection with a ground side in Case 5.

In FIG. 16, the horizontal axis represents the frequencies, and the vertical axis represents the found antenna gains. As seen from FIG. 16, the antenna gains are drastically improved by connecting the ground-side feeding portion and the ground-side terminal of the receiver.

Figure 17:
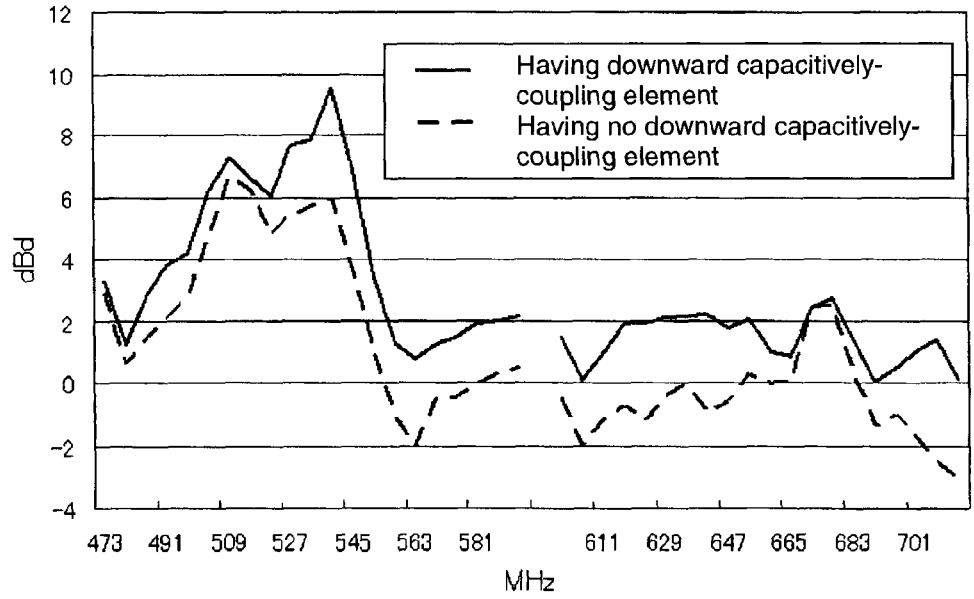
FIG. 17 is a characteristic graph showing the relationship between an antenna gain and a frequency with respect to the presence and absence of a downward capacitive-coupling element in Case 5.

In FIG. 15, measurements were also made for both of a case where a downward capacitively-coupling element 23 was disposed and a case where no downward capacitively-coupling element 23 was disposed. The results of measurements are shown in FIG. 17. As seen from FIG. 17, the antenna has an improved antenna gain by including such a downward capacitively-coupling element.

Case 6 (Example)

Figure 18:
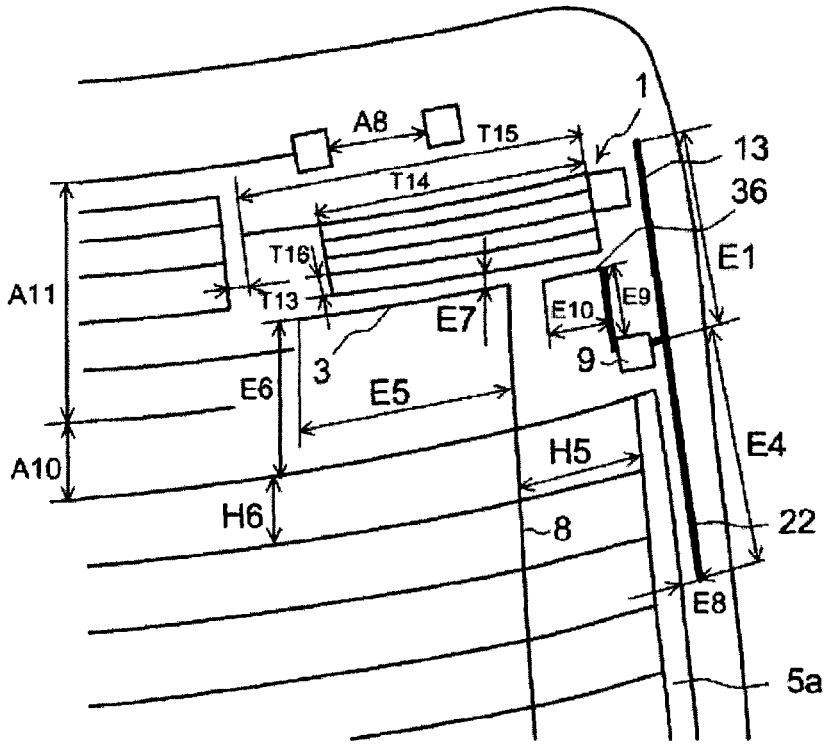
FIG. 18 is a plan view showing the example of Case 6.

As in Case 5, a high frequency glass antenna for automobiles was fabricated as shown in FIG. 18 (seen from a car-interior-side), and antenna gains were measured. An antenna conductor for AM/FM broadcast bands, which was not directly related to the present invention, was also disposed. In FIG. 18, a capacitively-coupling conductor 22 for a defogger, which extended downward from an ground-side feeding portion 9, was disposed in order that the electrical connection between the ground-side feeding portion 9 and a defogger function as capacitively-coupling with a bus bar 5*a*. As the adjusting element were disposed three adjusting elements of a first capacitively-coupling conductor 3 disposed in proximity to an antenna conductor 1 and connected to a highest heating wire, a second capacitively coupling conductor 36 in proximity to the antenna conductor and connected to the ground-side feeding portion 9, and an upwardly extending element 13 connected to the capacitively-coupling conductor 22 for the defogger. A short-circuit line 8 was also disposed in the heating wires connected to the first capacitively-coupling conductor 3. The dimensions of the respective parts are listed below.

E1: 70 mm, E4: 70 mm, E5: 65 mm, E6: 50 mm, E7 (which also applies to the distance between the second capacitively-coupling conductor 36 and the antenna conductor 1): 5 mm, E8: 5 mm, E9: 33 mm, E10: 30 mm, T13: 20 mm, T14: 100 mm, T15: 130 mm, T16 (which also applies to the distance between conductors adjacent to the antenna conductor 1): 5 mm, H5: 50 mm, H6: 35 mm, A8: 40 mm, A10: 35 mm, A11: 124 mm, Line width of antenna conductor: 0.7 mm, Line width of antenna conductor for AM/FM broadcast bands: 0.7 mm, Line width of respective heating lines 7: 1 mm, Conductor width of upwardly extending element 13, downward capacitively-coupling element 23 and attaching portion of second capacitively-coupling conductor 36: 3 mm, Feeding portion of antenna conductor 1 and ground-side feeding portion: 12×12 mm, Feeding portion of antenna conductor for AM/FM broadcast bands: 12×12 mm, Width of capacitively-coupling portion between first capacitively-coupling conductor 3 and antenna conductor 1: 55 mm The measurements were made for horizontally polarized waves at frequencies of every 6 MHz in a range of 473 to 713 MHz, and the average antenna gain at such every frequency was found. The other conditions were the same as Case 1.

In FIG. 18, the measurements were made for both of a case where the capacitively-coupling conductor 22 for the defogger and the upwardly extending element 13 were disposed (example: having capacitively-coupling with DEF) and a case where the capacitively-coupling conductor 22 for the defogger and the upwardly extending element 13 were not disposed (comparative example: having no capacitively-coupling with DEF). The results of measurement are shown in FIG. 19.

Figure 19:
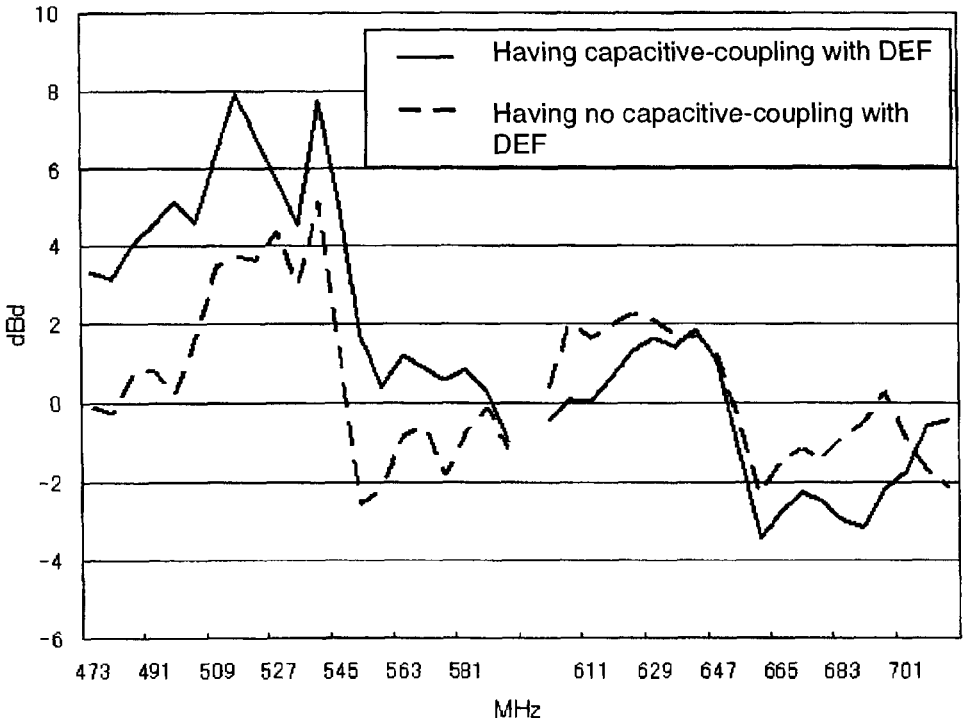
FIG. 19 is a characteristic graph showing the relationship between an antenna gain and a frequency with respect to the presence and absence of capacitive-coupling between a ground-side and DEF in Case 6.

In FIG. 19, the horizontal axis represents the frequencies, and the vertical axis represents the found antenna gains. When the ground-side feeding portion 9, the capacitively-coupling conductor 22 for the defogger and the upwardly extending element 13 were connected together, and when the ground-side feeding portion 9 and the bus bar 5*a* of the defogger were electrically connected together through capacitively-coupling, the antenna gains were stayed about the same for high frequencies and improved for low frequencies as the priority band of a digital terrestrial television broadcast as seen from FIG. 19.

Figure 20:
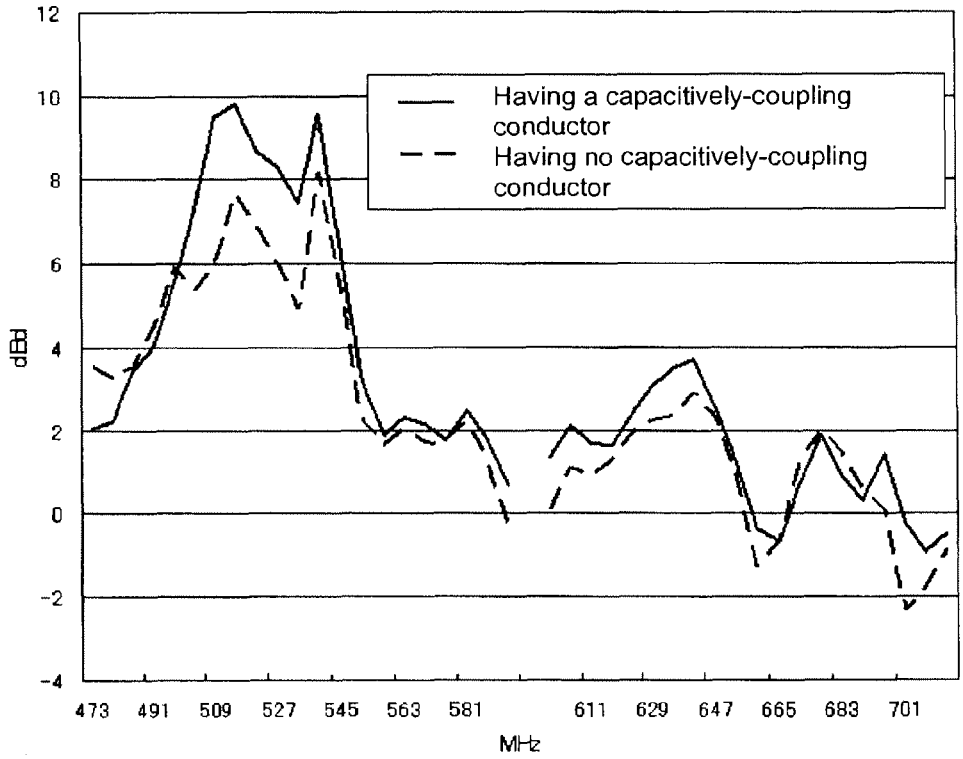
FIG. 20 is a characteristic graph showing the relationship between an antenna gain and a frequency with respect to the presence and absence of a capacitively-coupling conductor in Case 6.
Figure 21:
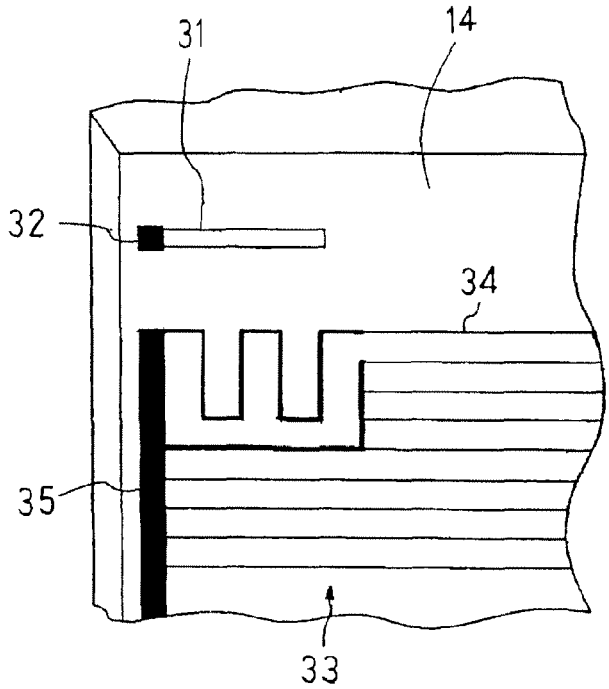
Fig. 21 PRIOR ART
FIG. 21 is a plan view of prior art.

In FIG. 18, measurements were also made for both of a case where the first capacitively-coupling conductor 3 was disposed and a case where no first capacitively-coupling conductor 3 was disposed. The results of measurements are shown in FIG. 20. As seen from FIG. 20, the antenna has an improved antenna gain by including the first capacitively-coupling conductor 3.

INDUSTRIAL APPLICABILITY

The present invention is applicable to a glass antenna for automobiles, which receives a digital terrestrial television broadcast band, a UHF band analog television broadcast, a US digital television broadcast, an EU digital television broadcast or a Chinese digital television broadcast. The present invention is also applicable to the Japanese FM broadcast band (76 to 90 MHz), the US FM broadcast band (88 to 108 MHz), the television VHF band (90 to 108 MHz and 170 to 222 MHz), the 800 MHz band for automobile telephones (810 to 960 MHz), the 1.5 GHz band for automobile telephones (1.429 to 1.501 GHz), the UHF band (300 MHz to 3 GHz), the GPS (Global Positioning System) and the GPS signal for artificial satellites (1,575.42 MHz).

Further, the present invention is also applicable to the Dedicated Short Range Communication (DSRC) in a band of 915 MHz and communication for the automobile keyless entry system (300 to 450 MHz).

The entire disclosure of Japanese Patent Application No. 2007-165077 filed on Jun. 22, 2007 including specification, claims, drawings and summary is incorporated herein by reference in its entirety.

What is claimed is:

1. A high frequency glass antenna for automobiles, wherein an electric heating defogger having a plurality of heating wires and a plurality of bus bars for feeding the heating wires, an antenna conductor, a feeding portion for the antenna conductor, a grounding conductor, and a grounding-side feeding portion for the grounding conductor are adapted to be disposed in or on a rear window glass sheet for automobiles in such a way that a signal received by the antenna conductor is taken out from the feeding portion for the antenna conductor, utilizing the grounding-side feeding portion as a ground reference, being characterized in that;

the defogger forming at least one portion of the grounding conductor; and the grounding-side feeding portion being electrically connected to the defogger;

wherein the feeding portion for the antenna conductor and the grounding-side feeding portions are each configured to be connected to a peripheral circuit for the antenna.

2. The high frequency glass antenna according to claim 1, wherein the grounding-side feeding portion is disposed at a bus bar closest to the feeding portion in the plurality of bus bars.

3. The high frequency glass antenna according to claim 1, wherein the grounding-side feeding portion is connected to the defogger through a connection conductor for the defogger in terms of direct-current.

4. The high frequency glass antenna according to claim 1, wherein the grounding-side feeding portion is electrically connected to the defogger through capacitive coupling.

5. The high frequency glass antenna according to claim 1, wherein the grounding conductor includes an adjusting element connected to at least one of the defogger and the grounding-side feeding portion.

6. The high frequency glass antenna according to claim 5, wherein the adjusting element includes a capacitively-coupling conductor, the capacitively-coupling conductor being disposed to be close and capacitively coupled to the antenna conductor, starting at least one of the defogger and the grounding-side feeding portion.

7. The high frequency glass antenna according to claim 6, wherein the grounding conductor includes a short-circuit line, and the capacitively-coupling conductor being disposed, starting at a heating wire, the short circuit line being disposed to extend so as to traverse at least two of the plurality of heating wires, starting at a joint between the capacitively-coupling conductor and the heating wire or at a location close to the joint.

8. The high frequency glass antenna according to claim 1, wherein the antenna conductor and the capacitively-coupling conductor have an average distance of 0.1 to 35 mm between capacitively-coupling portions thereof.

9. The high frequency glass antenna according to claim 1, wherein when a desired frequency band has a center frequency having a wavelength of $\lambda_0$ in the air, glass has a shortening coefficient of wavelength of k, the formula of k=0.64 is established, and the formula of $\lambda_g=\lambda_0 \cdot k$ is established, the heating wire has a conductor length extending from a joint between the capacitively-coupling conductor and the heating wire to a bus bar closest to the joint, the conductor length being set at $(1/8)\cdot(\lambda_g/4)$ to $(5/4)\cdot(\lambda_g/4)$.

10. The high frequency glass antenna according to claim 1, wherein the heating wire has a conductor length extending from a joint between the capacitively-coupling conductor and the heating wire to a bus bar closest to the joint, the conductor length being 10 to 100 mm.

11. The high frequency glass antenna according to claim 5, wherein the adjusting element is attached to a bus bar closest to the grounding-side feeding portion and has an upwardly extending element extending upwardly along an outline of the rear window glass sheet.

12. The high frequency glass antenna according to claim 11, wherein when a desired frequency band has a center frequency having a wavelength of $\lambda_0$ in the air, glass has a shortening coefficient of wavelength of k, the formula of k=0.64 is established, and the formula of $\lambda_g=\lambda_0 \cdot k$ is established, the upwardly extending element has a conductor length set at $(7/8)\cdot(\lambda_g/4)$ to $(15/8)\cdot(\lambda_g/4)$.

13. The high frequency glass antenna according to claim 11, wherein the upwardly extending element has a conductor length set at 70 mm to 150 mm.

14. The high frequency glass antenna according to claim 5, wherein the adjusting element is attached to a bus bar closest to the grounding-side feeding portion and has a downward capacitively-coupling element extending downwardly along the bus bar and capacitively coupled to the bus bar.

15. The high frequency glass antenna according to claim 14, wherein when a desired frequency band has a center frequency having a wavelength of $\lambda_0$ in the air, glass has a shortening coefficient of wavelength of k, the formula of k=0.64 is established, and the formula of $\lambda_g=\lambda_0 \cdot k$ is established, the downward extending element has a conductor length set at $(7/8)\cdot(\lambda_g/4)$ to $(15/8)\cdot(\lambda_g/4)$.

16. The high frequency glass antenna according to claim 14, wherein the downward capacitively-coupling element has a conductor length set at 70 mm to 150 mm.

17. The high frequency glass antenna according to claim 5, wherein the adjusting element is attached to a bus bar closest to the grounding-side feeding portion, the bus bar extends upwardly beyond a joint with a highest heating wire connected thereto and has a laterally extending element extending from an upper end of the bus bar or a portion thereof close to the upper end so as to be parallel to the heating wire.

18. The high frequency glass antenna according to claim 17, wherein when a desired frequency hand has a center frequency having a wavelength of $\lambda_0$ in the air, glass has a shortening coefficient of wavelength of k, the formula of k=0.64 is established, and the formula of $\lambda_g=\lambda_0 \cdot k$ is established, the laterally extending element has a conductor length set at $(5/8)\cdot(\lambda_g/4)$ to $(19/16)\cdot(\lambda_g/4)$.

19. The high frequency glass antenna according to claim 17, wherein the laterally extending element has a conductor length set at 50 mm to 95 mm.

20. A rear window glass sheet having a high frequency glass antenna for automobiles defined in claim 1.

* * * * *